US007913554B2

(12) United States Patent
Bittleston et al.

(10) Patent No.: US 7,913,554 B2
(45) Date of Patent: Mar. 29, 2011

(54) METHOD AND APPARATUS FOR BALANCED PRESSURE SAMPLING

(75) Inventors: Simon H. Bittleston, Cambs (GB); Jonathan W. Brown, Sugar Land, TX (US); Julian J. Pop, Houston, TX (US); Ashley C. Kishino, Houston, TX (US); Christopher S. Del Campo, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 2 days.

(21) Appl. No.: 12/485,472

(22) Filed: Jun. 16, 2009

(65) Prior Publication Data

US 2009/0250212 A1 Oct. 8, 2009

Related U.S. Application Data

(63) Continuation of application No. 11/274,707, filed on Nov. 15, 2005, now Pat. No. 7,565,835.

(51) Int. Cl.
*E21B 49/10* (2006.01)

(52) U.S. Cl. ..... 73/152.24; 166/264

(58) Field of Classification Search ..... 73/152.24; 166/264

See application file for complete search history.

(56) References Cited

U.S. PATENT DOCUMENTS

| | | | |
|---|---|---|---|
| 3,577,782 | A | 5/1971 | Aitken |
| 3,577,783 | A | 5/1971 | Whitten et al. |
| 3,780,575 | A | 12/1973 | Urbanosky |
| 3,859,851 | A | 1/1975 | Urbanosky |
| 4,256,282 | A | 3/1981 | Goldschild et al. |
| 4,480,687 | A | 11/1984 | Terral |
| 4,507,957 | A | 4/1985 | Montgomery et al. |
| 4,630,679 | A | 12/1986 | Reeves, III et al. |
| 4,771,635 | A | 9/1988 | Trevillion |
| 4,860,581 | A | 8/1989 | Zimmerman et al. |
| 4,861,986 | A | 8/1989 | Arnold |
| 4,877,956 | A | 10/1989 | Priest |
| 4,936,139 | A | 6/1990 | Zimmerman et al. |
| 4,951,750 | A | 8/1990 | Wetzel, Jr. |
| 4,953,618 | A | 9/1990 | Hamid et al. |
| 5,002,127 | A | 3/1991 | Dalrymple et al. |
| 5,095,745 | A | 3/1992 | Desbrandes |
| 5,230,244 | A | 7/1993 | Gilbert |
| 5,247,830 | A | 9/1993 | Goode |
| 5,269,180 | A | 12/1993 | Dave et al. |
| 5,303,775 | A | 4/1994 | Michaels et al. |
| 5,335,542 | A | 8/1994 | Ramakrishnan et al. |
| 5,377,755 | A | 1/1995 | Michaels et al. |
| 5,497,321 | A | 3/1996 | Ramakrishnan et al. |
| 5,533,570 | A | 7/1996 | Streich et al. |
| 5,718,287 | A | 2/1998 | Streich et al. |

(Continued)

FOREIGN PATENT DOCUMENTS

| | | |
|---|---|---|
| GB | 2377952 | 1/2003 |

(Continued)

*Primary Examiner* — Hezron Williams
*Assistant Examiner* — Rodney T Frank
(74) *Attorney, Agent, or Firm* — Dave R. Hofman

(57) ABSTRACT

A method of sampling fluid from a rock formation penetrated by a borehole includes positioning a downhole tool having a flow line in the borehole, establishing an inlet port through which fluid passes from a first point in the formation into the flow line, establishing an outlet port through which fluid passes from the flow line into a second point in the formation, and passing fluid between the formation and the flow line through the inlet and outlet ports.

15 Claims, 8 Drawing Sheets

U.S. PATENT DOCUMENTS

| | | | |
|---|---|---|---|
| 5,738,173 | A | 4/1998 | Burge et al. |
| 5,823,267 | A | 10/1998 | Burge et al. |
| 5,875,850 | A | 3/1999 | Burge et al. |
| 5,884,701 | A | 3/1999 | Von Plahn |
| 5,934,374 | A | 8/1999 | Hrametz et al. |
| 6,006,832 | A | 12/1999 | Tubel et al. |
| 6,032,744 | A | 3/2000 | Burge et al. |
| 6,058,773 | A | 5/2000 | Zimmerman et al. |
| 6,116,345 | A | 9/2000 | Fontana et al. |
| 6,125,934 | A | 10/2000 | Lenn et al. |
| 6,182,013 | B1 | 1/2001 | Malinverno et al. |
| 6,190,141 | B1 | 2/2001 | Henry |
| 6,276,454 | B1 | 8/2001 | Fontana et al. |
| 6,286,596 | B1 | 9/2001 | Schnatzmeyer et al. |
| 6,296,044 | B1 | 10/2001 | Brooks et al. |
| 6,394,181 | B2 | 5/2002 | Schnatzmeyer et al. |
| 6,435,279 | B1 | 8/2002 | Howe et al. |
| 6,439,307 | B1 | 8/2002 | Reinhardt |
| 6,467,544 | B1 | 10/2002 | Brown et al. |
| 6,481,503 | B2 | 11/2002 | Hamilton et al. |
| 6,557,632 | B2 | 5/2003 | Cernosek |
| 6,603,314 | B1 | 8/2003 | Kostelnicek et al. |
| 6,615,917 | B2 | 9/2003 | Bussear et al. |
| 6,631,767 | B2 | 10/2003 | Pringle et al. |
| 6,640,912 | B2 | 11/2003 | Reddoch |
| 6,659,177 | B2 | 12/2003 | Bolze et al. |
| 6,663,361 | B2 | 12/2003 | Kohl et al. |
| 6,668,924 | B2 | 12/2003 | Bolze et al. |
| 6,688,390 | B2 | 2/2004 | Bolze et al. |
| 6,729,398 | B2 | 5/2004 | Ringgenberg et al. |
| 6,729,399 | B2 | 5/2004 | Follini et al. |
| 6,745,835 | B2 | 6/2004 | Fields |
| 6,761,062 | B2 | 7/2004 | Shapiro |
| 6,840,321 | B2 | 1/2005 | Restarich et al. |
| 6,851,444 | B1 | 2/2005 | Kohl et al. |
| 6,863,126 | B2 | 3/2005 | McGlothen et al. |
| 6,865,933 | B1 | 3/2005 | Einarson et al. |
| 6,877,332 | B2 | 4/2005 | DiFoggio |
| 6,892,816 | B2 | 5/2005 | Pringle et al. |
| 6,902,004 | B2 | 6/2005 | de Rouffignac et al. |
| 6,907,797 | B2 | 6/2005 | DiFoggio |
| 6,913,077 | B2 | 7/2005 | MacKenzie |
| 6,929,070 | B2 | 8/2005 | Fu et al. |
| 6,966,234 | B2 | 11/2005 | Carnegie et al. |
| 6,978,838 | B2 | 12/2005 | Parlar et al. |
| 7,000,697 | B2 | 2/2006 | Goode et al. |
| 7,062,958 | B2 | 6/2006 | Diakonov et al. |
| 7,094,736 | B2 | 8/2006 | Jones et al. |
| 7,140,436 | B2 | 11/2006 | Grant et al. |
| 7,155,967 | B2 | 1/2007 | Rylander et al. |
| 7,246,664 | B2 | 7/2007 | Shammai et al. |
| 7,427,504 | B2 | 9/2008 | Torgersen et al. |
| 2004/0043501 | A1 | 3/2004 | Means et al. |
| 2004/0065440 | A1 | 4/2004 | Farabee et al. |
| 2004/0216521 | A1 | 11/2004 | Shammai et al. |
| 2005/0166961 | A1 | 8/2005 | Means et al. |

FOREIGN PATENT DOCUMENTS

| | | |
|---|---|---|
| WO | WO95/16103 | 6/1995 |
| WO | WO96/28633 | 9/1996 |
| WO | WO98/14686 | 4/1998 |
| WO | WO01/63093 | 8/2001 |
| WO | WO02/075114 | 9/2002 |
| WO | WO03/025326 | 3/2003 |
| WO | WO2004/020982 | 3/2004 |
| WO | WO2004/044380 | 5/2004 |
| WO | WO2004/099564 | 11/2004 |
| WO | WO2005/023396 | 3/2005 |
| WO | WO2005/071220 | 8/2005 |
| WO | WO2005/086699 | 9/2005 |
| WO | WO97/40255 | 10/2007 |

METHOD AND APPARATUS FOR BALANCED PRESSURE SAMPLING

CROSS-REFERENCE TO RELATED APPLICATIONS

This application is a continuation of U.S. application Ser. No. 11/274,707, filed on Nov. 15, 2005, which claims the benefit of and priority to U.S. Provisional Application No. 60/552,882, filed on Nov. 17, 2004.

BACKGROUND OF THE INVENTION

1. Technical Field

The invention relates to methods and apparatus for recovering samples of reservoir fluid.

2. Background of the Related Art

A reservoir is a rock formation in which fluids such as hydrocarbons, e.g., oil and natural gas, and water have accumulated. Due to gravitational forces, the fluids in the reservoir are segregated according to their densities, with the lighter fluid towards the top of the reservoir and the heavier fluid towards the bottom of the reservoir. One of the main objectives of formation testing is to obtain representative samples of the reservoir fluid. Commonly, reservoir fluid is sampled using a formation tester, such as the Modular Formation Dynamics Tester™ (MDT™), available from Schlumberger Technology Corporation, Houston, Tex. In practice, the formation tester is conveyed, generally on the end of a wireline, to a desired depth in a borehole drilled through the formation. The formation tester includes an inlet device, which may be a probe or packer, that can be set against the borehole wall and through which reservoir fluid can be drawn into a flow line in the formation tester. The formation tester also typically includes a pump and one or more sample chambers. Typically, fluid monitoring devices, such as optical fluid analyzers, are also inserted into the flow line to monitor the type and quality of fluid flowing at various points in the flow line.

The inlet device or probe is inserted into the formation through mudcake lining on the borehole wall. Thus, the fluid initially drawn into the flow line through the probe is a mixture of reservoir fluid and mud filtrate. To obtain a sufficiently quality fluid sample, a cleanup step in which mud filtrate is purged from the flow line is performed. This step typically involves pumping the fluid drawn into the flow line back into the borehole. However, the fluid discharged into the borehole contains reservoir fluid, which can contaminate the drilling mud in the borehole and change the properties of the drilling mud, possibly necessitating additional steps to clean or stabilize the drilling mud. As pumping continues, more and more of the reservoir fluid is consumed around the inlet of the probe. Eventually, a fluid mixture that is more representative of the reservoir fluid starts to enter the flow line. Fluid monitoring devices, such as optical fluid analyzers, are used to monitor the content of the fluid entering the flow line and how the fluid proceeds through the tool and can assist in determining when the fluid entering the flow line is of sufficient quality to be sampled.

When the mud filtrate content of the fluid entering the flow line is reduced to an acceptable level, the sample chamber is opened and fluid in the flow line is pumped into the sample chamber. Typically, the sample chamber includes a cylinder in which a piston is disposed. The sample is collected on top of the piston while the backside of the piston is exposed to either borehole pressure or atmospheric pressure. Typically, the backside of the piston is exposed to borehole pressure, which means that fluid is pumped into the sample chamber against borehole pressure. Borehole pressure is normally deliberately maintained above formation pressure to keep the well safe. Thus, pumping fluid into the sample against borehole pressure often results in the sample collected in the sample chamber being over-pressured, creating an unstable pressure-volume-temperature (PVT) environment. Moreover, in cases where a higher pressure differential is provided, additional power is typically required to pump the sample into the downhole tool.

Despite such advances in sampling technology, there remains a need to provide techniques that are capable of efficiently obtaining samples representative of the formation. It is desirable that such techniques provide pressure sufficient to prevent samples from deteriorating or becoming biphasic. It is further desirable that such techniques provide a pressure that is at a reduced pressure differential from the sample to facilitate pumping or drawing fluid into the downhole tool. Such techniques preferably provide one or more of the following, among others: maintaining sample pressure above the bubble point, reducing sampling time, reducing power requirements for sampling and balancing pressures to the formation.

SUMMARY OF THE INVENTION

In one aspect, the invention relates to a method of sampling reservoir fluid from a rock formation penetrated by a borehole. The method comprises positioning a downhole tool having a flow line in the borehole, establishing an inlet port through which fluid passes from a first point in the formation into the flow line, establishing an outlet port through which fluid passes from the flow line into a second point in the formation, and passing fluid between the formation and the flow line through the inlet and outlet ports.

In another aspect, the invention relates to a tool for sampling reservoir fluid from a rock formation penetrated by a borehole. The tool comprises a tool body for positioning in the borehole, the tool body having at least one flow line, a plurality of fluid communicating devices coupled to the tool body, the fluid communicating devices comprising an inlet device which provides an inlet port through which fluid passes from the formation into the flow line and an outlet device which provides an outlet port through which fluid passes from the flow line into the formation, and a fluid chamber disposed in the tool body for collecting fluid from the flow line.

Other features and advantages of the invention will be apparent from the following description and the appended claims.

DETAILED DESCRIPTION OF THE INVENTION

The invention will now be described in detail with reference to a few preferred embodiments, as illustrated in accompanying drawings. In the following description, numerous specific details are set forth in order to provide a thorough understanding of the invention. However, it will be apparent to one skilled in the art that the invention may be practiced without some or all of these specific details. In other instances, well-known features and/or process steps have not been described in detail in order to not unnecessarily obscure the invention. The features and advantages of the invention may be better understood with reference to the drawings and discussions that follow.

Embodiments of the invention provide a method and an apparatus for sampling reservoir fluid. The apparatus includes a flow line and two ports that can be set against a wall of a borehole traversing a rock formation. When the ports are set against the borehole wall, reservoir fluid can be circulated from the formation into the flow line and back into the formation, avoiding discharge of fluid in the flow line into the borehole. Since the reservoir fluid is not discharged into the borehole, contamination of the drilling mud in the borehole is also avoided.

The apparatus for sampling reservoir fluid includes at least one sample chamber for collecting a sample of the reservoir fluid. The method for sampling reservoir fluid includes filling the sample chamber with fluid in the flow line against formation pressure. The method and apparatus of the invention advantageously minimize the differential pressure across the fluid collected in the sample chamber. The apparatus can be used to create a flow circuit in the rock formation, which can allow in-situ core flood test. Such test can be used to obtain a direct measurement of the near-borehole permeability.

Figure 1A:
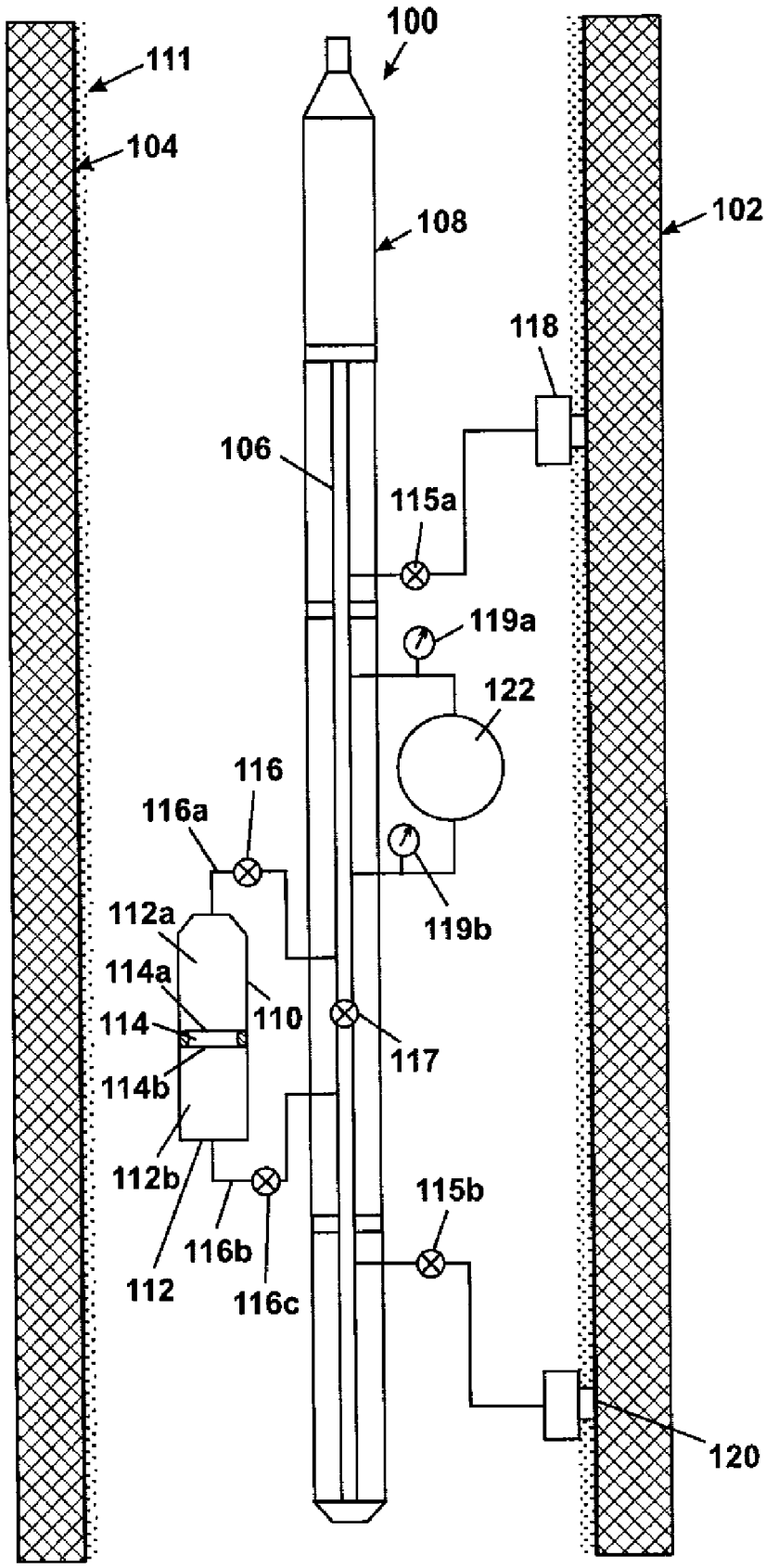
FIG. 1A is a schematic representation of a tool for sampling reservoir fluid.

FIG. 1A is a schematic representation of a tool 100 for sampling reservoir fluid in a formation 102 traversed by a borehole 104 according to an embodiment of the invention. The borehole 104 may be an open hole or a cased hole. The tool 100 includes a flow line 106 defined in a tool body 108. Various devices such as valves and pumps may be disposed in the flow line 106 to control flow of fluid through the flow line 106.

The tool body 108 may be a unitary housing or may be made of multiple housings coupled together. The tool 100 includes a sample chamber 110 normally disposed in the tool body 108 for collecting reservoir fluid from the formation 102. In practice, the tool 100 may include one or more sample chambers. Examples of sample chambers suitable for use in the invention include, but are not limited to, the Modular Sample Chamber, Multi-Sample module, or Single-Phase Multi-Sample Chamber included in the Schlumberger MDT™.

A typical sample chamber 110 includes a cylinder 112 and a piston 114 disposed in the cylinder 112. The piston 114 defines compartments 112*a*, 112*b* inside the cylinder 112. The compartment 112*a* is for collecting a sample of the reservoir fluid. The compartment 112*b* may be filled (preferably) with water or other types of fluids, such as hydraulic fluid, and maintained at a desired pressure. The fluid in the compartment 112*b* will be displaced into the flow line 106 as reservoir fluid is collected in the compartment 112*a*.

Fluid can flow from the flow line 106 into the compartment 112*a* through a flow line 116*a*. A valve 116 may be used to control communication between the flow lines 106, 116*a*. As described, the valve 116 is a surface-controlled valve, but may also be controlled at the surface or downhole by manual or automatic means. Fluid can flow from the compartment 112*b* into the flow line 106 through a flow line 116*b*. A valve 116*c*, which may be surface-controlled, may also be used to control communication between the flow lines 106 and 116*b*. A valve 117 (or other suitable device) may be disposed in the flow line 106 to prevent communication between the flow lines 116*a*, 116*b* when the surface-controlled valve 116 in the flow line 116*a* is open.

The tool 100 includes probes (or ports) 118, 120 that can be set against the borehole 104 wall to establish fluid communication between the flow line 106 and the formation 102. Examples of probes suitable for use in the invention include the Single-Probe Module or Dual-Probe Module included in the Schlumberger MDT™ or described in U.S. Pat. Nos. 4,860,581 and 6,058,773. Typically, the probe modules include a probe coupled to a frame. The frame and the probe can be extended and retracted relative to the tool body. In one embodiment, the probe 118 is an inlet probe providing a channel through which fluid can flow from the formation 102 into the flow line 106, and the probe 120 is an outlet probe providing a channel through which fluid can flow from the flow line 106 into the formation 102. When the probes 118, 120 are set against the borehole 104 wall, fluid can be circulated from the formation 102 into the flow line 106 and back into the formation 102. This allows discharge of fluid from the flow line 106 into the borehole 104 to be avoided, thus eliminating or minimizing contamination of drilling mud in the borehole 104.

A method for sampling reservoir fluid includes a cleanup phase in which fluid is circulated from the formation 102 into the flow line 106 and back into the formation 102. This circulation continues until the fluid in the flow line 106 is sufficiently clean to be captured in the sample chamber 110. When the fluid in the flow line 106 is sufficiently clean, the valve 116 may be opened and the valve 117 may be closed to allow fluid to be transferred from the flow line 106 into the compartment 112*a* of the sample chamber 110. At this point, the backside 114*b* of the piston 114 is exposed to formation pressure through the flow line 116*b*, which is hydraulically connected to the probe 120. Thus, the sample chamber 110 is filled with fluid against formation pressure. This minimizes the change in pressure of the sample collected in the sample chamber 110 since the pressure differential between the flow lines 116*a*, 116*b* need only be large enough to displace the piston 114.

Additional valves, such as valves 115*a, b* may also be provided to selectively divert fluid through the flow lines. These valves are shown near inlets to selectively isolate the inlets. In this manner, fluid may be selectively permitted to enter and/or exit the inlets/outlets. Gauges, such as pressure gauges 119*a, b* may also be provided to measure parameters of fluid in the flow lines.

The flow rate and pressure of reservoir fluid from the flow line 106 into the compartment 112*a* may be controlled by metering the fluid flowing out of the compartment 112*b* using, for example, choke valves. Alternately, throttle valves at the inlet of the compartment 112*a* may be used to regulate flow rate and pressure of the reservoir fluid into the compartment 112*a* as taught by, for example, Zimmerman et al. in U.S. Pat. No. 4,860,581. A throttle valve 116*c* at the outlet of compartment 112*b* may also be used to regulate the flow rate and pressure of the reservoir fluid into the compartment 112*a*. In addition, flow rate and pressure of reservoir fluid into the compartment 112*a* may be controlled by the rate and/or duty cycle of a pump in the flow line 106 (e.g., pump 122). Pumps may be positioned at various locations in the flow line(s), for example, on either side of valve 117.

Figure 1B:
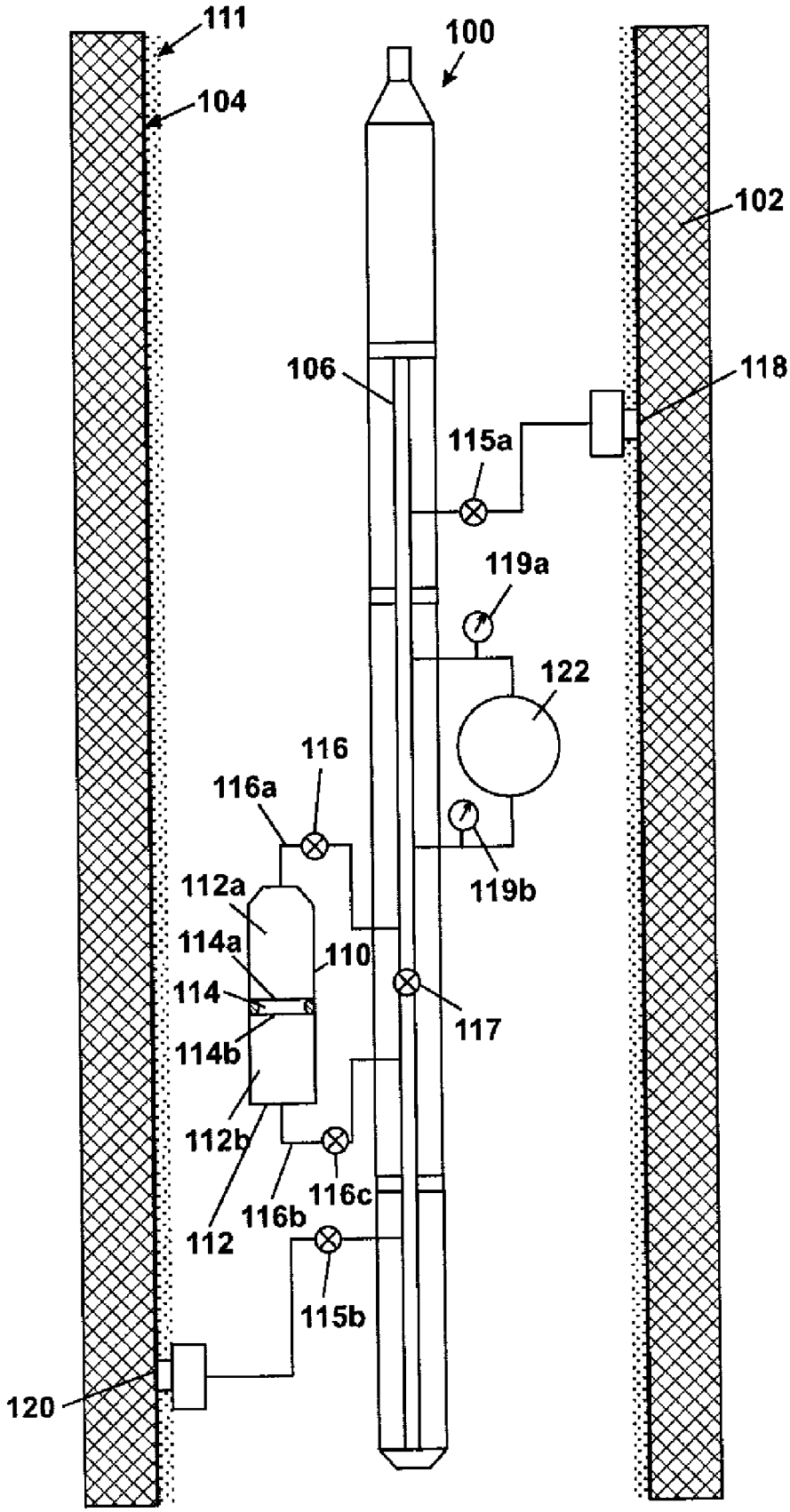
FIGS. 1B and 1C show alternate arrangements for the inlet and outlet probes shown in FIG. 1A.
Figure 1C:
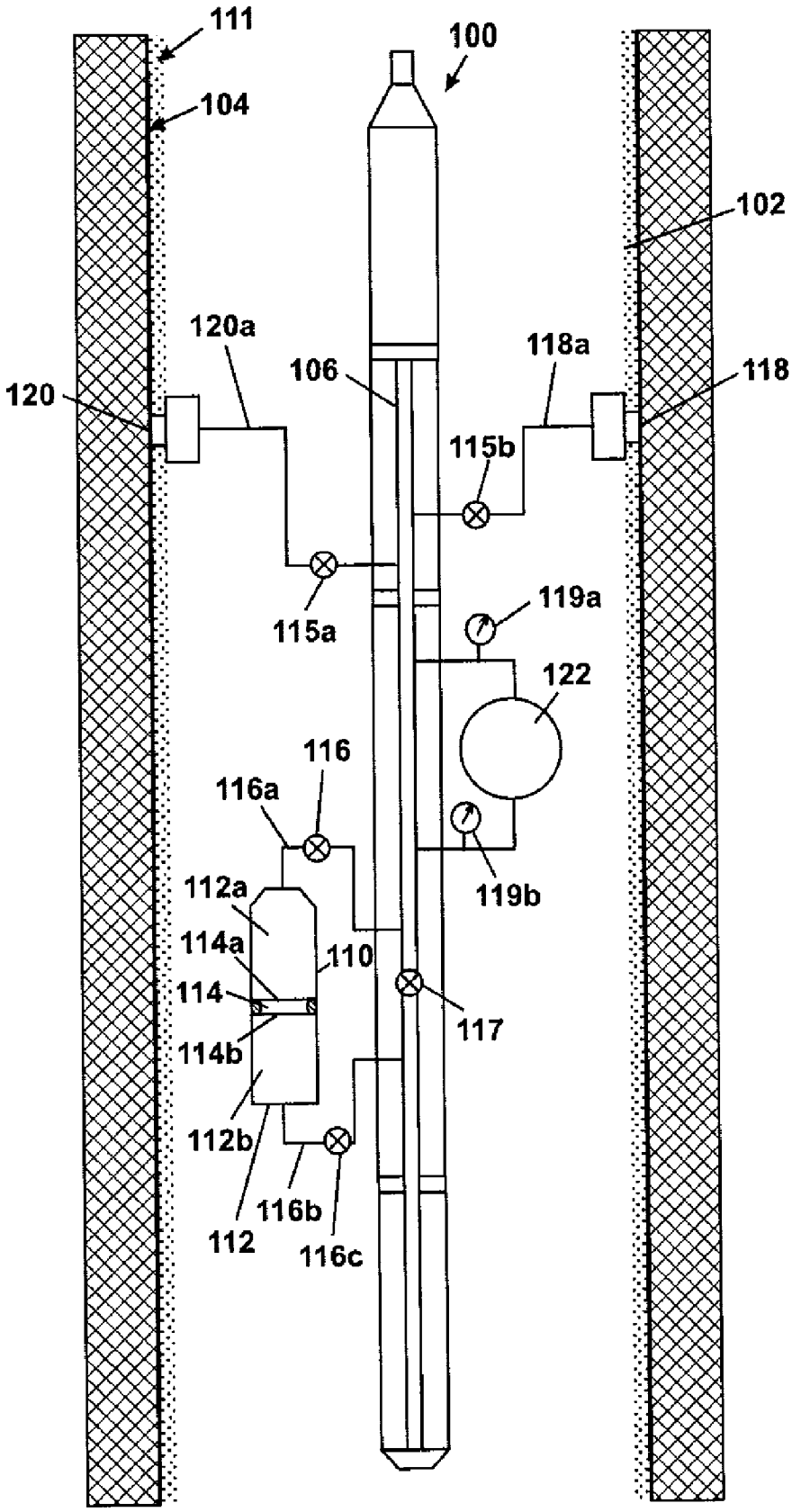

To avoid or reduce contamination of the fluid captured in the sample chamber 110, the point at which the probe 118 engages the formation 102 should be sufficiently distanced from the point at which the probe 120 engages the formation 102. This can be achieved by maintaining a minimum vertical distance between the probes 118, 120 and/or by locating the probes 118, 120 such that they are diametrically opposed (FIGS. 1B and 1C). The tool 100 should also be placed in the borehole 104 such that when the outlet probe 120 is extended it engages a porous (and/or permeable) section of the formation 102. Otherwise, it may be difficult to discharge the fluid in the flow line 106 into the formation 102.

The tool 100 may include a pump 122 in the flow line 106. The pump 122 may be any type of pump, e.g., reciprocating piston, retractable piston, or hydraulic powered pump. The pump 122 may be positioned to be operable in a pump-in mode, pump-out mode, or internal mode. For example, the pump 122 can pump fluid from the borehole 104 into the flow line 106 for distribution to various points in the tool 100 as needed. In another example, the pump 122 can draw fluid from the formation 102 into the flow line 106 and pump the fluid in the flow line 106 back into the formation 102. The pump 122 can also pump from one point in the flow line 106 to any other point in it. For example, the pump 122 can pump fluid from the flow line 106 into the sample chamber 110. However, the invention is not limited to use of the pump 122 to pump fluid from the formation 102 into the sample chamber 110 and/or out into the formation 102. In an alternate embodiment, the tool 100 may rely on pressure differential between the probes 118, 120 to create flow of fluid from the formation 102 into the flow line 106 and sample chamber 110 and/or from the flow line 106 into the formation 102. For the pump-in mode, pump-out mode, or internal mode, the backside 114*b* of piston 114 may be exposed to formation pressure.

In some cases, a pressure differential sufficient to drive fluid through the flow lines may be provided a pump, hydrostatic pressure and/or pressure differentials across different formations. For example, where an inlet is positioned at a first formation having a first pressure, and an outlet is positioned at a second formation having a second pressure, a sufficient pressure differential between the first and second pressures may be used to facilitate movement of fluid.

Figure 1D:
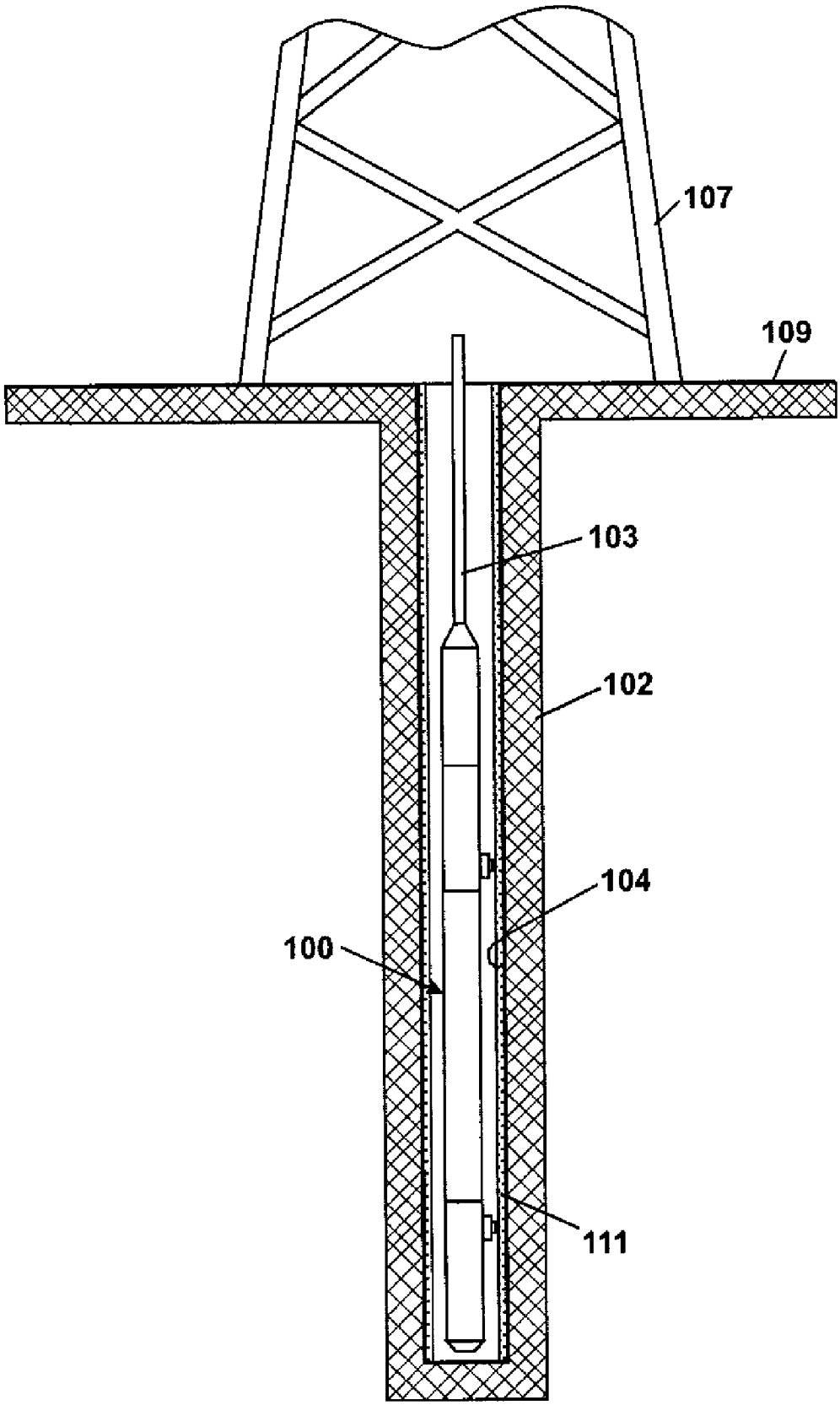
FIG. 1D is a schematic view of the tool of FIG. 1A in an example environment in which the invention can be practiced.

FIG. 1D is a schematic of an example environment within which the present invention may be used. In the illustrated example, the present invention is carried by the tool 100. The tool 100 is deployable into the borehole 104 penetrating the subterranean formation 102 and suspended therein with a conventional wireline 103, or conductor or conventional tubing or coiled tubing (not shown), below a rig 107 at the surface 109, as will be appreciated by one of skill in the art. The borehole 104 may be an open hole or a cased hole. A mudcake lining 111 is formed on the borehole 104 wall by drilling mud.

While the tool 100 is depicted as a modular downhole tool, it will be appreciated by one of skill in the art that the tool 100 may be used in any downhole tool. For example, the tool 100 may be used in a drilling tool including a drill string and a drill bit. The drilling tool may be of a variety of drilling tools, such as measurement-while-drilling (MWD), logging-while-drilling (LWD), or other drilling system. The tool 100 may have a variety of configurations, such as modular, unitary, wireline, coiled tubing, autonomous, drilling, and other variations of downhole tools.

Figure 1E:
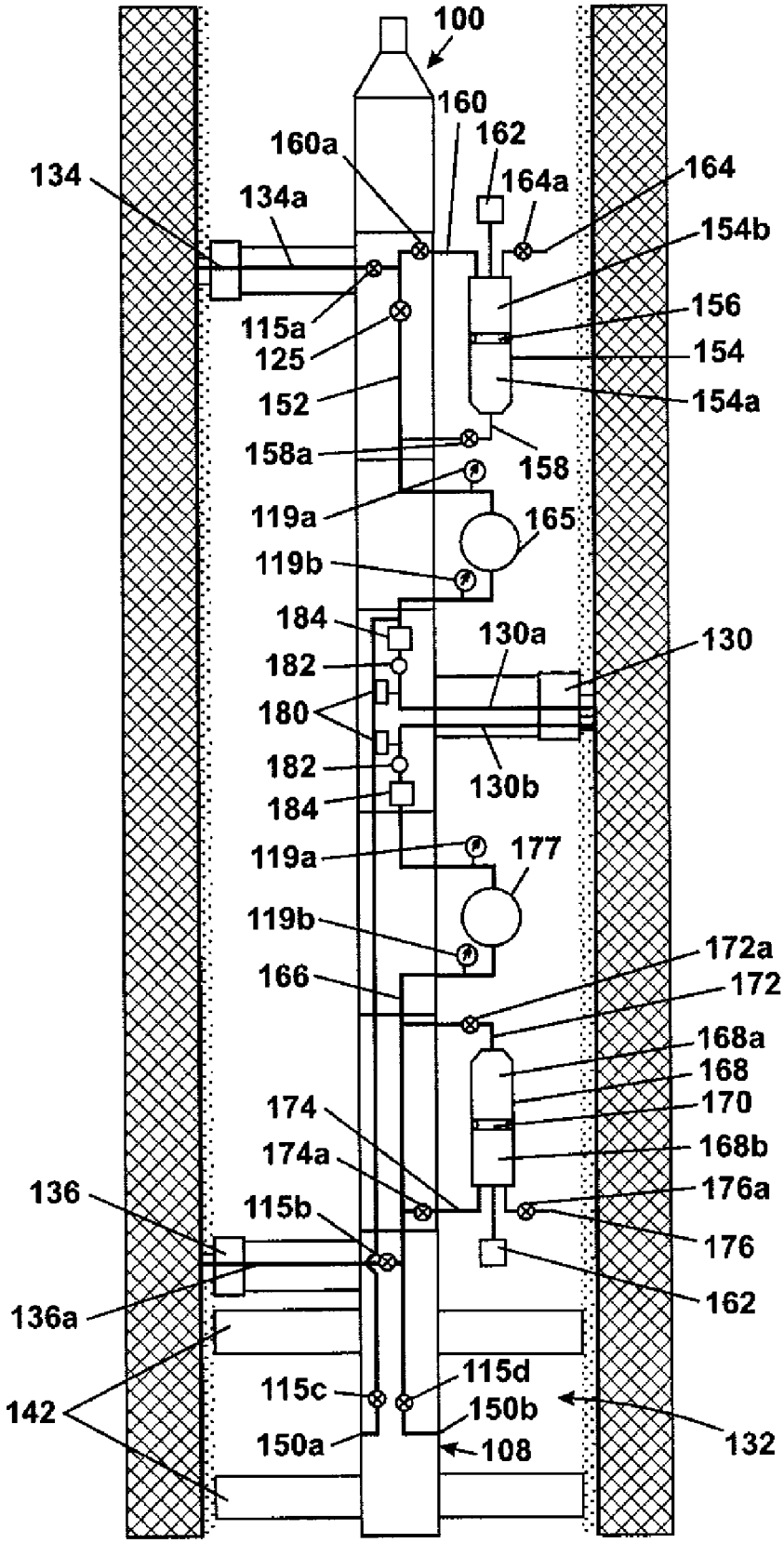
FIG. 1E is a detailed view of an alternate configuration of the tool of FIG. 1A.

FIG. 1E shows another configuration of the tool 100 that includes multiple inlet ports, outlet ports, and sample chambers for multiple sampling of reservoir fluid. The tool 100 is provided with a plurality of fluid communicating devices, e.g., inlet devices 130, 132 and outlet devices 134, 136. While a specific arrangement of inlet and outlet devices is provided, it will be appreciated that one or more inlet and one or more outlet devices may be used. The illustrated example shows a variety of types of inlet and outlet devices. Such devices may be functional as inlet and/or outlet devices as desired. Examples of probes and/or packers used in downhole tools are described in U.S. Pat. Nos. 6,301,959; 4,860,581; 4,936,139; 6,585,045; 6,609,568; and 6,719,049 and U.S. Patent Application Publication No. 2004/0000433.

In the illustrated example, the inlet device 130 is a probe having two channels or ports 130*a*, 130*b*. One or more such inlets may be provided in any of the inlet/outlet devices. The use of an additional inlet 130*b* is typically used to draw contamination away from the formation fluid as it is drawn into inlet 130*a* as described more fully in U.S. Patent Application Publication No. 2004/0000433. Such inlets/outlets may be used across the same or different formations along the wellbore.

The inlet device 132 includes dual packers 142 mounted on the tool body 108. The dual packers 142 sealingly engage the borehole 104 wall. Inlets 150*a*, 150*b* are provided on the portion of the tool body 108 between the dual packers 142. The inlets 150*a*, 150*b* are in fluid communication with the fluid in the borehole 104 between the packers 142. As shown with respect to inlet device 132, one or more inlets may also be provided between packers. Multiple sets of dual packers with inlets positioned therebetween may be provided. The use of one or more inlets for probes and/or packers may also be used to provide an optional release of fluid into the wellbore and/or formation as desired.

While inlet device 132 is described as being used for drawing fluid into the downhole tool, the inlet device 132 may also be used as an outlet device. This may particularly be useful in cases where a large surface area along the borehole is needed to find a flowing zone.

The outlet devices 134, 136 are probes having single flow lines or ports 134*a*, 136*a*, respectively. The outlet devices 134, 136 are positioned at various depths in the wellbore. The position of the inlets may be selected to provide inlets and outlets at desired locations about the wellbore.

The tool 100 is provided with flow line 152, which is selectively and fluidly connected to flow line 134*a* of the outlet device 134 and to flow line 130*a* of the inlet device 130. In this configuration formation fluid may be drawn in through inlet device 130 and discharged through outlet device 134. Flowline 166 may also be used to selectively and fluidly connect 130*b* and 150*b*. Flow line 166 may also be used to selectively and fluidly connect 130*b* and 136*a*. With such configurations, formation fluid may be drawn in through inlet device 130 and discharged through inlet device 132 and/or 136 (functioning as an outlet device). Flow lines may be positioned in the tool to fluidly connect a variety of inlet and outlet devices to perform the sampling operation. Valves, such as valves 115*c*, 115*d* and 125, may be provided in the flow lines to permit selective fluid communication of the input and output devices. In this manner, a variety of configurations may be used.

Sample chamber 154 is positioned along the flow line 152. Sample chamber 154 may be any suitable fluid chamber capable of collecting fluid from the formation, such as previously listed. Other examples of sample chambers are taught in, for example, U.S. Pat. Nos. 4,936,139; 4,860,581; 6,467,544 and 6,659,177. In the illustrated example, the sample chamber 154 has compartments 154*a*, 154*b* defined by a piston 156 movably disposed in the chamber. The compartment 154*a* is typically for collecting formation fluid from the flow line 152. The compartment 154*b* may be filled with water or other type of fluid, e.g., hydraulic fluid, and may be maintained at any desired pressure.

The compartment 154*a* is selectively and fluidly connected to the flow line 152 through flow line 158 and valve 158*a*. The compartment 154*b* is selectively and fluidly connected to the flow line 152 through flow line 160 and valve 160*a*. The compartment 154*b* may also be provided with additional pressure sources. As shown, compartment 154*b* is fluidly connected to a pressure tank 162 and may be selectively exposed to the borehole 104 through the port 164 and valve 164*a*. The pressure tank 162 can receive fluid displaced from compartment 154*b*.

Pump 165 is provided in the flow line 152. Pump 165 may be operated in pump-in/out, pump-up/down, or internal mode as previously explained. One or more pumps may be provided at various locations to draw fluid into or eject fluid from the tool. The pump may be operated at a desired speed to manipulate pressures in the flow lines.

The tool 100 is provided with flow line 166, which is fluidly connected to flow line 136*a* of the outlet device 136, to flow line 130*b* of the inlet device 130, and to inlet 150*b* of the inlet device 132. Sample chamber 168 is positioned along the flow line 166. The sample chamber 168 may be any suitable fluid chamber as previously described. The sample chamber 168 has compartments 168*a*, 168*b* defined by a piston 170 movably disposed in the chamber.

The compartment 168*a* may be used for collecting formation fluid from the flow line 166. The compartment 168*b* may be filled with water or other type of fluid, e.g., hydraulic fluid, and may be maintained at any desired pressure. The compartment 168*a* is selectively and fluidly connected to the flow line 166 through flow line 172 and valve 172*a*. The compartment 168*b* is selectively and fluidly connected to the flow line 166 through flow line 174 and valve 174*a*. The compartment 168*b* may also be provided with a pressure source, such as a pressure tank 162, and may be selectively exposed to the borehole 104 through the port 176 and valve 176*a*. The pressure tank 162 can receive fluid displaced from the compartment 168*b*. Pump 177 is provided in the flow line 166. Pump 177 may be provided to pump fluid through the flowline. As with pump 165, pump 177 may be operated in pump-in/out, pump-up/down, or internal mode as previously explained.

The flow lines 130*a*, 130*b* of the inlet device 130 may include pretest pistons 180, sensors 182 and fluid analyzers 184. The sensors 182 may measure parameters, such as pressure differential, between the flow lines 130*a*, 130*b*. The pretest pistons 180 may be provided to draw fluid into the tool and perform a pretest operation. Pretests are typically performed to generate a pressure trace of the drawdown and buildup pressure in the flowline as fluid is drawn into the downhole tool through the probe.

Pretest pistons, sensors, fluid analyzers and other devices may be positioned along various flow lines to measure various parameters of the fluid and/or perform tests. For example, the pretest piston may be positioned along each flow line at each inlet to create pressure variations. Data from the pretest piston may be used to generate pressure curves of the formation. These curves may be compared and analyzed. Additionally, the pretest pistons may be used to draw fluid into the tool to break up the mudcake lining on the borehole wall. The pistons may be cycled synchronously, or at disparate rates, to align and/or create pressure differentials across the respective flow lines. The pretest pistons, sensors and analyzers may also be used to diagnose and/or detect problems, such as improper seal, contamination or other problems encountered during operation.

The tool 100 may be provided with a variety of additional devices, such as restrictors, diverters, processors, and other devices for manipulating flow and/or performing various formation evaluation operations. The tool 100 may also be provided with a variety of sensors or other monitoring devices, which may be used to monitor, for example, temperature, pressure, and fluid properties. Examples of sensors include, but are not limited to, pressure gauges, optical fluid analyzers, and viscometers. The sensors may be positioned in a variety of locations depending on the desired measurement. The sensors may be part of a module designed to manipulate and/or monitor fluids to determine fluid properties. The configuration of the fluid measuring and/or manipulating devices is preferably flexible and permits various testing and manipulation.

The tool 100 described in FIG. 1E may be used to sample reservoir fluid from the formation 102 as previously described. The tool 100 allows fluid to be sampled at multiple depths in the formation synchronously or asynchronously, e.g., through the inlet devices 130, 132. The tool 100 also allows samples of fluids having different qualities to be collected from the same depth in the formation, e.g., using the inlet device 130 which has two inlet flow lines or ports. For balanced pressure sampling, the sample chambers 154, 168 can be filled against formation pressure as previously described, i.e., by exposing the compartments 154*b*, 168*b* to the ports or channels in outlet devices 134, 136, respectively. For low shock sampling, the sample chambers 154, 168 may be filled against borehole pressure, i.e., by exposing the compartments 154*b*, 168*b* to the borehole 104 through the ports 164, 176, respectively. Fluid flow into the sample chambers or out of the sample chambers can be controlled as previously described to ensure that formation fluid is collected and maintained above its bubble point pressure.

Preferably, the fluid is pumped at a pressure to maintain the sample quality. In particular, it is preferred that the sample is pumped at a pressure above its bubble point to prevent the sample from becoming bi-phasic. In some configurations, the buffer cavity of the sample chambers (i.e. 154*b*) may be positioned in fluid communication with the wellbore to provide pressure to the sample cavity (i.e. 154*a*) during sampling. However, the present configurations may also be used to apply formation pressure to the buffer cavity to apply pressure to the sample cavity. The formation is typically lower than the wellbore pressure, thereby providing a lower pressure differential in the sample chamber. It may be desirable to use this lower pressure differential to reduce the amount of pumping power required during sampling.

The tool 100 may be physically implemented in a variety of ways. The tool 100 may be conveniently constructed from modules such as those described in U.S. Pat. Nos. 4,860,581 and 6,058,773, both assigned to the assignee of the present invention. The following are descriptions of modular tool configurations.

Figure 2A:
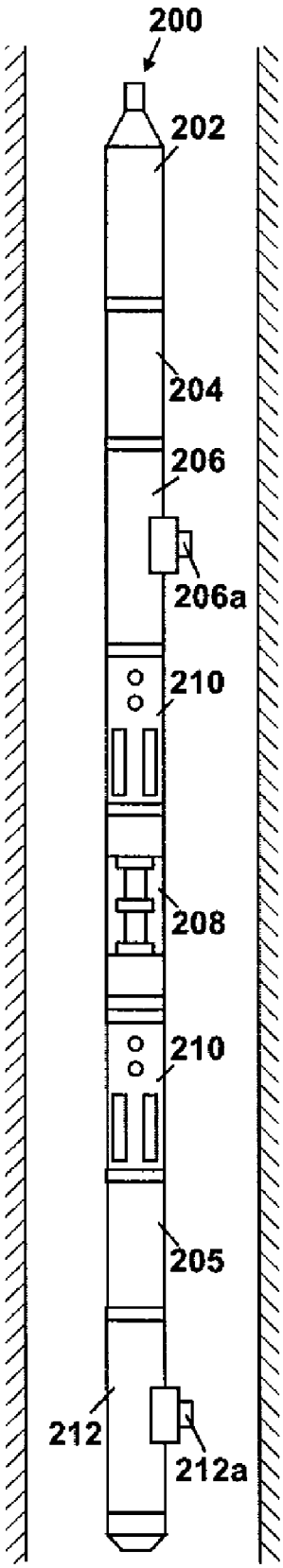
FIGS. 2A-2E show various modular tool configurations for sampling reservoir fluid.
Figure 2B:
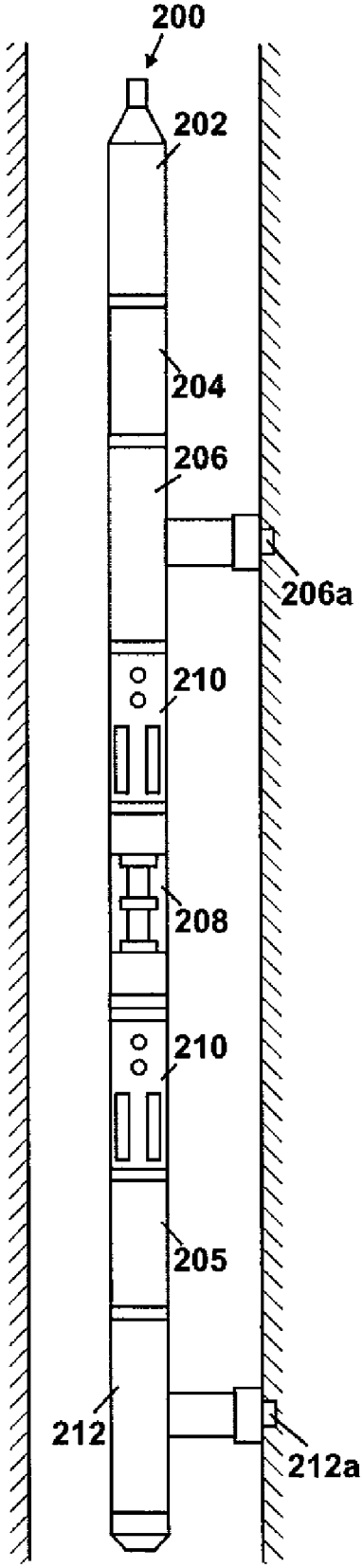

FIG. 2A shows a tool configuration 200 including a power cartridge 202, hydraulic power modules 204, 205, single probe modules 206, 212, pump module 208, and sample modules 210. The power cartridge 202 supplies electrical power to the modules in the tool 200. The tool 200 has a bussed flow line (not shown) that runs through each module. In some cases, the bussed flow line runs through each module except for the power cartridge 202. In one embodiment, the tool 200 also includes hydraulic busses (not shown) that run through the hydraulic power modules 204, 205 and the probe modules 206, 212, respectively. The hydraulic power modules 204, 205 supply the hydraulic power needed to extend/retract the probes 206*a*, 212*a* of the probe modules 206, 212, respectively. Alternately, a single hydraulic power module may provide hydraulic power to both probe modules 206, 212. FIG. 2B shows the probes 206*a*, 212*a* in an extended position.

Figure 2C:
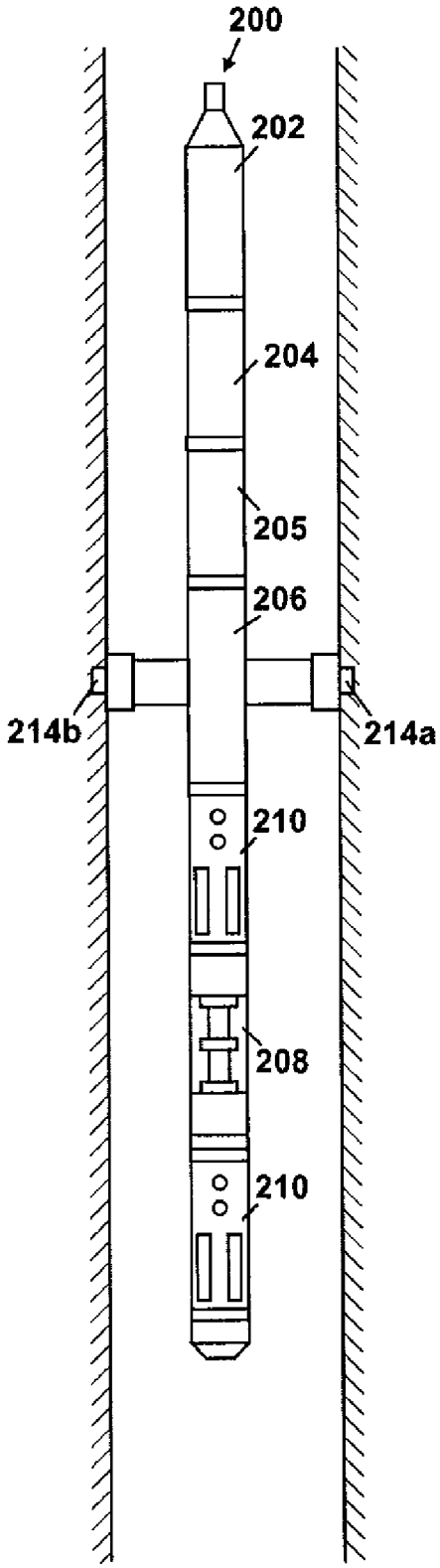

FIG. 2C shows the single probe modules (206, 212 in FIG. 2A) replaced with a dual probe module 214. One of the probes of the dual probe module 214, e.g., probe 214*a*, can serve as the inlet probe while the other, e.g., probe 214*b*, serves as the outlet probe.

Figure 2D:
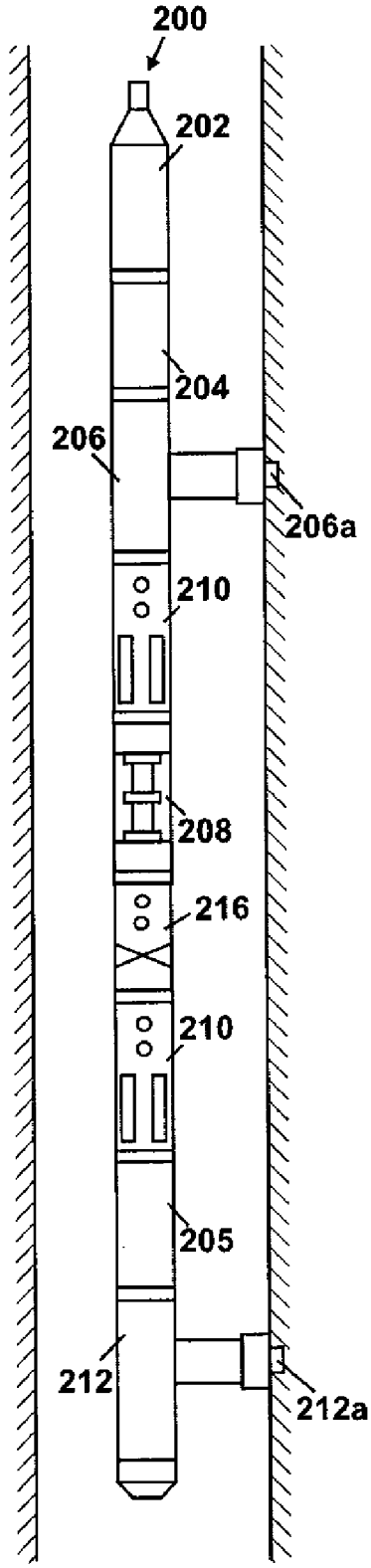

FIG. 2D shows the tool 200 incorporating a flow control module 216. The flow control module 216 measures and controls flow rate and pressure into the sample module(s) 210.

Figure 2E:
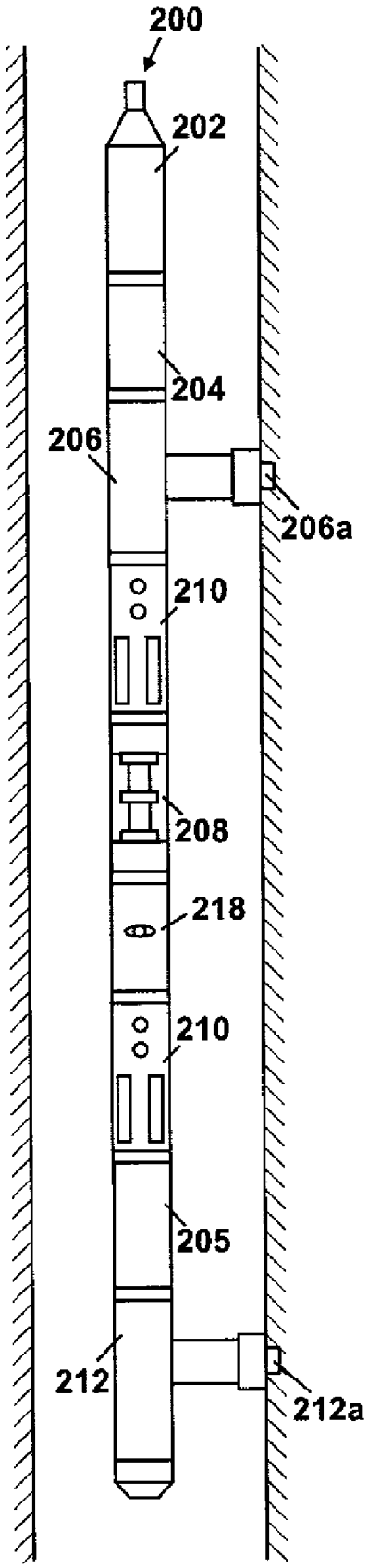

FIG. 2E shows the tool 200 incorporating a fluid type analyzer 218, such as the Live Fluid Analyzer (LFA) included in the Schlumberger MDT™. The fluid type analyzer 218 can be installed below the pump 208 as shown or above the pump 208. Depending on the location of the fluid type analyzer 218 relative to the pump 208, the fluid type analyzer either analyzes the input to the pump 208 or the output of the pump 208. The output of the fluid type analyzer 218 can be used to determine when to open the sample chamber in the sample module(s) 210 to capture fluid. As previously discussed, it is not mandatory that a pump is included in the tool. However, when the pump is not included the modules in the tool 200 should be arranged such that pressure differential can be used advantageously to drive flow from the formation into the flow line of the tool 200 and back into the formation or chamber in the sample module(s) 210.

The invention typically provides the following advantages. During the cleanup phase, fluid from the flow line of the tool is discharged into the formation. This avoids contamination of the drilling mud in the borehole. Further, fluid can be pumped or flowed into the sample chamber against formation pressure (as opposed to against borehole pressure). This creates a stable PVT environment as the pressure differential across the sample chamber is minimized. Another advantage is that when taking the sample a flow circuit is created between the inlet probe and outlet probe. The invaded zone in the formation will act as a barrier to the flow into the borehole along this circuit, creating a flow channel through the rock formation. By varying the flow rates/differential pressure of sampling, an in-situ flow test of the formation can be performed so that a direct measurement of near-borehole permeability can be made.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method of sampling fluid from a formation penetrated by a borehole, comprising:

positioning a downhole tool having a flow line in the borehole;

establishing an inlet port through which fluid passes from a first point in the formation into the flow line;

establishing an outlet port through which fluid passes from the flow line into a second point in the formation;

passing fluid between the formation and the flow line through the inlet and outlet ports to create a flow circuit between the inlet port and the outlet port; and performing an in-situ flow test of the formation using the created flow circuit;

wherein an invaded zone in the formation acts as a barrier to fluid flow into the borehole along the flow circuit.

2. The method of claim 1 wherein performing the in-situ flow test of the formation using the created flow circuit comprises measuring pressure at the inlet port and the outlet port after creating the flow circuit.

3. The method of claim 2 wherein performing the in-situ flow test of the formation using the created flow circuit further comprises measuring at least one additional parameter of the formation or formation fluid at the inlet port and the outlet port after creating the flow circuit.

4. The method of claim 1 wherein performing the in-situ flow test of the formation using the created flow circuit comprises varying a flow rate between the inlet port and the outlet port after creating the flow circuit.

5. The method of claim 1 wherein performing the in-situ flow test of the formation using the created flow circuit comprises varying a differential pressure between the inlet port and the outlet port after creating the flow circuit.

6. The method of claim 1 wherein establishing the inlet port and the outlet port comprises arranging the inlet port and the outlet port such that they are sufficiently close to create a substantially closed loop circulation circuit comprising the flow circuit in the rock formation, the flow line, the inlet port and the outlet port.

7. The method of claim 1 wherein performing the in-situ flow test of the formation using the flow circuit comprises directly measuring near-borehole permeability of the formation after creating the flow circuit.

8. The method of claim 1 wherein positioning the downhole tool in the borehole comprises positioning the downhole tool such that the outlet port is formed between the flow line and a porous section of the formation.

9. A method of sampling fluid from a formation penetrated by a borehole, comprising:

positioning in the borehole a downhole tool comprising a flow line, an inlet port configured to pass fluid from a first point in the formation into the flow line, and an outlet port configured to pass fluid from the flow line into a second point in the formation;

arranging the inlet port and the outlet port such that they are sufficiently close to create a substantially closed loop circulation circuit through the rock formation, the inlet port, the flow line, and the outlet port; and performing an in-situ flow test of the formation using the substantially closed loop circulation circuit;

wherein an invaded zone in the formation acts as a barrier to fluid flow into the borehole.

10. The method of claim 9 wherein the in-situ flow test comprises directly measuring near-borehole permeability of the formation.

11. The method of claim 9 wherein the in-situ flow test comprises measuring pressure at the inlet port and the outlet port.

12. The method of claim 11 wherein the in-situ flow test further comprises measuring at least one additional parameter of the formation or formation fluid at the inlet port and the outlet port.

13. The method of claim 9 wherein the in-situ flow test comprises varying a flow rate between the inlet port and the outlet port after creating the substantially closed loop circulation circuit.

14. The method of claim 9 wherein the in-situ flow test comprises varying a differential pressure between the inlet port and the outlet port after creating the substantially closed loop circulation circuit.

15. The method of claim 9 wherein positioning the downhole tool in the borehole comprises positioning the downhole tool such that the outlet port is formed between the flow line and a porous section of the formation.

* * * * *